United States Patent [19]

Schneeweiss

[11] Patent Number: 4,868,931

[45] Date of Patent: Sep. 26, 1989

[54] APPARATUS FOR ACTIVATING FLUSH VALVES FOR URINALS AND TOILET BOWLS

[76] Inventor: Morton Schneeweiss, 3004 Rexford A, Boca Raton, Fla. 33434

[21] Appl. No.: 177,041

[22] Filed: Apr. 4, 1988

[51] Int. Cl.[4] ..... E04D 5/08

[52] U.S. Cl. ..... 4/308; 4/249; 251/295

[58] Field of Search ..... 251/295, 293, 232; 4/308, 301, 302, 249

[56] References Cited

U.S. PATENT DOCUMENTS

| | | | |
|---|---|---|---|
| 244,381 | 7/1881 | Daggett | 4/308 |
| 543,945 | 8/1895 | Putnam | 4/308 |
| 761,278 | 5/1904 | William | 4/308 |
| 1,108,496 | 8/1914 | Fordyce | 4/249 |
| 1,241,037 | 9/1917 | Sharp, Jr. | 137/362 |
| 1,585,557 | 5/1926 | Miller | 4/249 |
| 1,614,346 | 1/1927 | Coret | 4/308 |
| 1,615,523 | 1/1927 | Shimo | 4/249 |
| 2,467,019 | 4/1949 | Farson | 4/308 |
| 3,624,845 | 12/1971 | Vorgang | 4/249 |
| 3,883,904 | 5/1975 | Wittman | 4/249 |

*Primary Examiner*—Henry J. Recla
*Assistant Examiner*—Edward C. Donovan
*Attorney, Agent, or Firm*—Leonard Bloom

[57] ABSTRACT

An apparatus is disclosed for activating the flush valve handles of conventional toilet room fixture, such as urinals, with the user's foot. The apparatus provides for both horizontal and vertical adjustment. These adjustments provide the apparatus with the necessary flexibility required for adaptation of the device for use with most conventional toilet room fixtures. Use of the hands in actuating the flush valve handle is avoided, thereby providing for sanitary use and avoiding inadvertent contamination due to a prior user.

20 Claims, 12 Drawing Sheets

APPARATUS FOR ACTIVATING FLUSH VALVES FOR URINALS AND TOILET BOWLS

FIELD OF THE INVENTION

The present invention relates to devices for activating the flush valves of toilet room fixtures and, in particular, to foot operated devices for activating the flush valves of urinals, toilets and the like, which are readily adjustable and adaptable for installation and use with existing (and new) toilet room fixtures.

BACKGROUND OF THE INVENTION

A common problem in many public toilet room facilities is the failure for users of such facilities to activate or otherwise flush the fixtures, so as to remove matter therefrom. There are many reasons for this oversight, one of which may be the fear of possible contamination or infection due to touching of the handle of the flush valve with the hand. This problem has become more pronounced by recent revelations concerning the existence of various fatal and dehabilitating communicable diseases.

To remedy this situation, several devices have been proposed which permits the activation of the flush valve with the foot. Representative of those devices, of which I am aware, are as follows:

| Pat. No. | Inventor | Date of Issue |
|---|---|---|
| 244,381 | Daggett | July 19, 1881 |
| 543,945 | Putnam | Aug. 6, 1895 |
| 1,241,037 | Sharp, Jr. | Sept. 25, 1917 |
| 1,614,346 | Coret | Jan. 11, 1927 |
| 1,615,523 | Shimo | Jan. 25, 1927 |
| 2,467,019 | Farson | April 12, 1949 |

Unfortunately, none of the above devices, nor any other devices of which I am aware, provide for sufficient adjustability and flexibility required to permit both the vertical and horizontal adjustment thereof required for adaptation to the handles on existing and new flush valves for toilet room urinals, toilet bowls and fixtures presently utilized. These prior art devices appear to be impractical and thus, to the best of my knowledge and belief, have not been implemented commercially.

More recently, photoelectric devices have been introduced in an effort to correct this problem of long standing. These photoelectric devices, which operate a solenoid valve, detect when a user has walked away from the urinal. These photoelectric devices are quite costly and, besides, are difficult and time consuming to adapt to existing installations on a retrofit basis, where access is often quite limited, and where both a licensed plumber as well as a licensed electrician are required.

SUMMARY OF THE INVENTION

Accordingly, it can be seen that there remains a need for a foot operated device for activating the flush valve of a toilet room fixture, such as a urinal or a toilet, which is readily adaptable for installation on conventional toilet room fixtures.

It is a further object of the present invention to provide such a device which has both horizontal and vertical adjustments, so that it may be readily and easily adjusted for adaption to fit various conventional toilet room fixtures.

Accordingly, there is disclosed herein such a device which has a lower horizontal adjustment for varying the placement of an activating foot pedal, a vertical adjustment for securing to a flush valve, various horizontal and vertical adjustments for those portions of the device extending between the foot pedal and the flush valve and supports therefor, which may be selectively vertically positioned and horizontally adjusted.

In accordance with the teachings of the present invention there is disclosed such an apparatus (or device) for activating a flush valve. This device includes a lower housing having a bottom, sidewalls and a cover, respectively. A pair of lower parallel channel guides are positioned on the bottom in the lower housing. These guides are further positioned such that the channels thereof are oriented facing one another. A pair of slidable foot lever pivots are provided. Each pivot has a respective pivot portion. Each pivot portion is slidably received in a respective channel formed in the lower channel guides. A foot lever is positioned in the lower housing between the pivots, extending outwardly therefrom. The foot lever has a first end which is positioned in the lower housing and a second opposite end which is positioned outside the lower housing for receiving a downward force thereon. The foot leer is secured to each slidable pivot. In this manner, the foot lever pivots about the pivot portion, such that downward movement on the second opposite end of the foot lever moves the first end upwardly, and further such that downward movement of the first end moves the second end upwardly. These slidable pivots permit the foot lever to be horizontally adjustable in the lower channel guides. A cup is pivotably secured to the first end of the foot lever for concomitant pivotal and slidable movement therewith. An extension rod (pipe or tubing) is provided. This rod has a lower end which is received within the pivotally secured cup in the lower housing for vertical upward and downward movement in response to the concomitant movement of the cup and for horizontal adjustable movement in response to the concomitant movement of the cup. An upper housing is provided having a bottom, sidewall and a cover, respectively. A coil spring housing is positioned in the upper housing, and a resilient coil spring is positioned in the coil spring housing. The extension rod (pipe or tubing) further has an upper end which includes a fixed bearing plate that extends axially therefrom. The upper end is received in the coil spring housing with the coil spring being positioned between the spring housing and the bearing plate for constantly urging the extension rod vertically downward. A flush arm is positioned in the upper housing and extends outwardly therefrom, perpendicularly to the extension rod. The flush arm has a first end which is located in the upper housing and a second opposite end which is located outside of the housing. The first end is pivotably secured to the upper end of the extension rod, such that upward movement of the upper end of the extension rod moves the first end of the flush arm concomitantly therewith. A bracket is secured to the handle of the flush valve. The bracket has a lower portion which is positioned below the flush valve, and the lower portion of the bracket has a channel formed therein. The second opposite end of the flush arm has at least one rotatable wheel carried thereon. The second opposite end of the flush arm is received within the lower portion of the bracket having the rotatable wheel rotatably guided in the channel. In this manner, upward movement of the first end of the flush arm pivotably moves the second opposite end of the flush arm downwardly, concomitantly moving the bracket having the handle of the flush valve secured thereto, whereby the flush valve is activated.

In a preferred embodiment, the bracket secured to the handle of the flush valve includes an upper and a lower split sleeve. Each of the sleeves is secured to the other about the handle of the flush valve. A plate is integrally formed with the lower split sleeve and extends downwardly therefrom. Means is provided for adjustably securing the channel to the plate oppositely of the lower split sleeve. Preferably, this means includes one of either the plate or channel having at least a pair of apertures formed therein. The other of either the plate or channel has at least a pair of elongated slots formed therein. A pair of bolts is provided. A respective bolt is received through one of each of a respective aperture and a respective slot. Finally, a nut is received on each bolt for securing the channel to the plate, whereby the channel may be adjusted vertically relative to the handle of the flush valve.

In another preferred embodiment, there is included at least two bearing brackets. Means is provided for adjustably securing the bearing brackets to a support, whereby the secured brackets extend horizontally therefrom. Each bearing bracket has a ring formed therein opposite of the support. A bearing sleeve is annularly positioned in each ring. The extension rod is received through the rings and the bearing sleeves are positioned therein. Positioned thusly, the rod is supported and slidably guided therein at an adjustable distance from the support. Preferably, the means for adjustably securing the bracket to the support includes the bearing brackets having an internally threaded recess formed therein. Also, a threaded rod is provided having one end secured to the support and a second opposite end threadably received in the internally threaded recess. In this fashion, the bearing brackets may be adjustably positioned horizontally relative to the support.

Viewed in another aspect, the present invention constitutes an improvement in apparatus for activating the flush valve of a urinal (or toilet bowl) by means of the user's foot, wherein the urinal (or toilet bowl) is mounted on a wall and/or the floor and extends forwardly therefrom. The improvement includes an upper housing means disposed on the wall substantially laterally of the flush valve. A first mounting means is provided for mounting the upper housing means on the wall, and the first mounting means includes means for adjusting the upper housing means in a horizontal direction substantially perpendicularly to the wall. A pivoted arm means is carried by the upper housing means and extends therefrom towards the urinal (and/or toilet bowl) and is disposed substantially below the flush valve. A bracket means is provided between the arm and the flush valve, and means are further provided for adjusting the bracket means in a vertical direction substantially parallel to the wall. A lower housing means is disposed below the upper housing means. A second mounting means is provided for mounting the lower housing means on the wall, and the second mounting means includes means for adjusting the lower housing means in a horizontal direction substantially perpendicular to the wall. A pivoted foot lever is carried by the lower housing means and extends therefrom outwardly of the wall. Means are provided, including a vertical rod extending between the upper housing means and the lower housing means, for connecting the pivoted foot lever to the pivoted arm. With this arrangement, when the pivoted foot lever is depressed by the user's foot, the rod moves vertically, pivoting the arm downwardly, and thus moving the bracket means and the handle on the flush valve downwardly to flush the urinal and/or toilet bowl. Additionally, the respective means for adjusting the upper and lower housing means in a horizontal direction, and the means for adjusting the bracket means in a vertical direction, thereby assure that the improvement is compatible with existing installations for retrofit purposes.

Viewed in yet another aspect, there is herein illustrated and described, and for use in combination with a urinal mounted on a wall and having a flush valve handle, an apparatus for actuating the flush valve handle by means of the user's foot. This apparatus includes first pivoted linkage means carried by the flush valve handle laterally of the urinal, and means are provided for adjustably mounting the first pivoted linkage means to the flush valve handle in substantially horizontal and vertical directions. A second pivoted linkage means includes a foot pedal extending substantially perpendicularly of the wall outwardly thereof and adapted to be depressed by the user's foot, and a means is provided for adjustably mounting the second pivoted linkage means relative to the wall for movement towards and away from the wall in a substantially horizontal direction. A third pivoted linkage means is pivotably connected between the first and second pivoted linkage means, and a further means is provided for adjusting the third pivoted linkage means in a substantially horizontal direction towards and away from the wall.

These and other objects of the present invention will become apparent from a reading of the following specification, taken in conjunction with the enclosed drawings.

DESCRIPTION OF PREFERRED EMBODIMENTS

Figure 1:
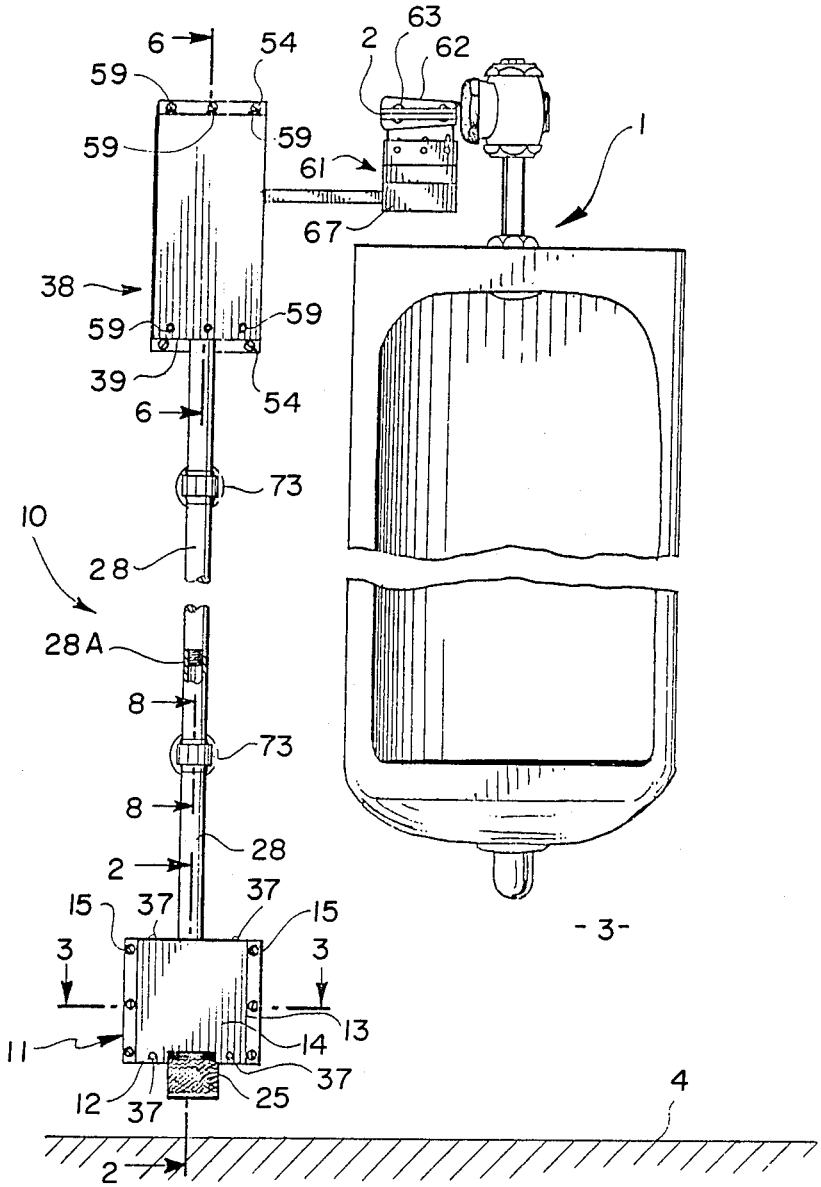
FIG. 1 is a front elevation view of the apparatus of the present invention, illustrating its adaptation for actuation of the flush valve of a wall-hung urinal.

Referring to FIG. 1 of the drawings, the apparatus 10 of the present invention is adapted for use with a conventional wall-mounted urinal 1 having a flush valve provided with a lever or handle 2. This flush valve handle 2 is of the type which is elongated and has one end fixed and its other end free. Such flush valve handles are activated by a vertical upward and downward motion of the free end of the handle pivoting about the fixed end. As illustrated, urinals 1 of this type are normally secured to a wall 3 and are held thereon above a floor 4.

Referring to FIGS. 1-5, the apparatus 10 includes a lower housing 11. Lower housing 11 has a bottom 12, sidewalls 13, and a removable cover 14, respectively. As illustrated, the lower housing 11 can be secured to the wall 3 by bolts (or anchors) 15. Alternatively, lower housing 11 may also be placed on and/or secured to the floor 4.

Positioned on the bottom 12 of lower housing 11 are a pair of U-shaped channel guides 16. Guides 16 are positioned parallel to each other and have the channels thereof facing each other. Each guide 16 also has a longitudinal slot 17 formed therein.

A foot lever (or foot pedal) 18 is partially positioned in the housing 11 and extends outwardly therefrom. The first end of the foot lever 18 is positioned in the housing 11. The second end of the foot lever 18 is located outside the housing 11 for receiving a downward force thereon that may be exerted by, for example, a human foot.

If desired, the channel guides 16 may be mounted on rails which are slidable and adjustable so as to extend the foot lever to the front of the urinal and/or toilet bowl. Additionally, an intermediate sliding piece 18A may be provided for further adjustability in certain installations. Thereafter, the intermediate sliding piece may be held in place by wingnuts 18B or other suitable means.

Figure 5:
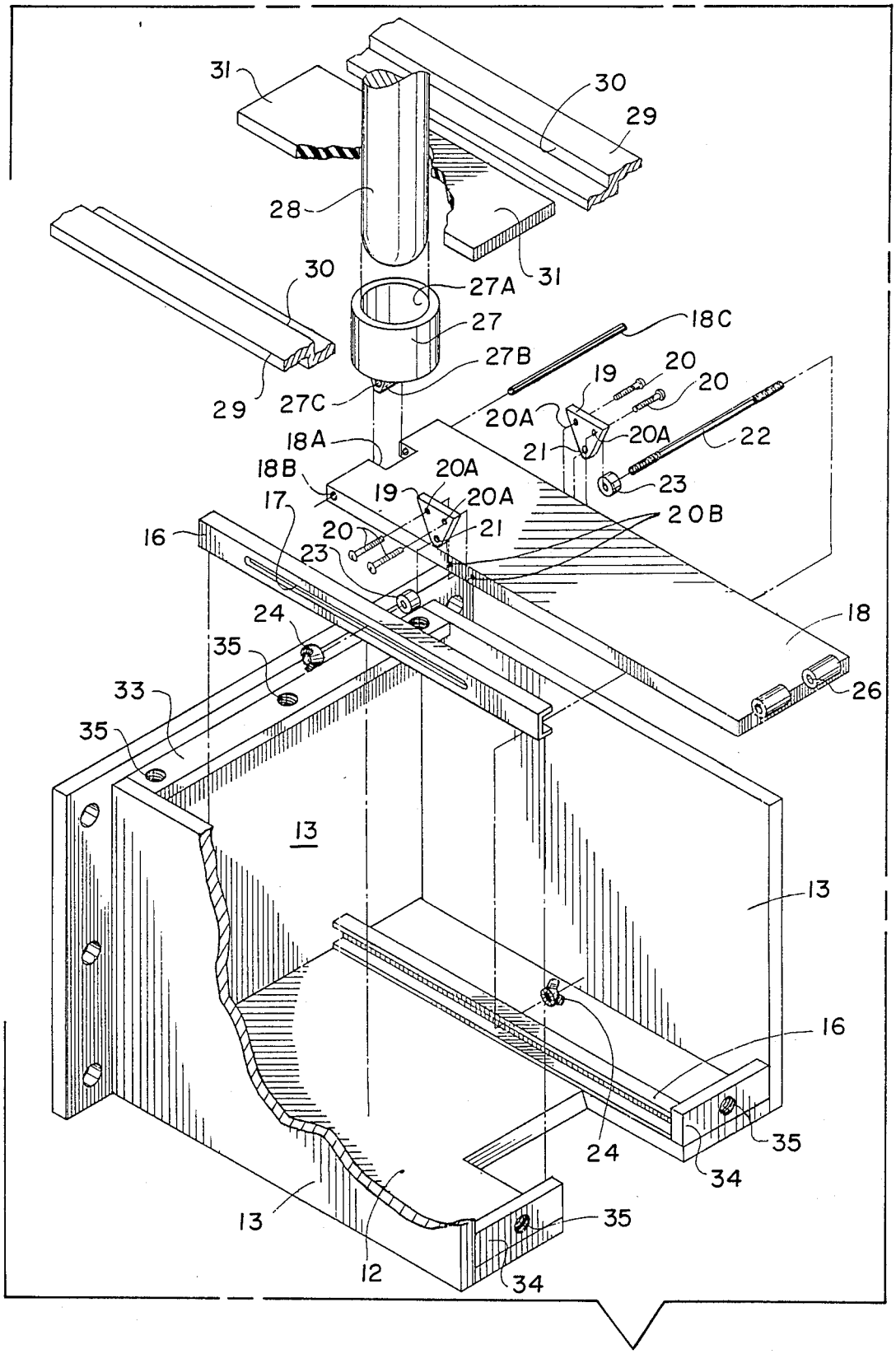
FIG. 5 is an exploded perspective view of the lower housing, vertical rod, and pivoted foot lever of the present invention, a portion of the sidewalls of the lower housing broken away for the sake of clarity.

Within the lower housing 11, and as shown more clearly in FIG. 5, a pair of slidable foot lever pivots 19 is provided. Each of the pivots 19 is, preferably, triangular in shape and has an upper portion and a lower pivot portion. The upper portion of each pivot 19 has a pair of apertures 20A formed therein. One of each of the pivots 19 is positioned on either side of the foot lever 18, where threaded bolts 20 are received through the apertures 20A and are received in tapped recesses 20B in the foot lever 18, thereby securing the pivots 19 thereto. Positioned thusly, the lower pivot portion is located below the foot lever 18.

The pivot portion of each pivot 19 has an aperture 21 formed therein below the foot lever 18. Each of the apertures 21 is formed so as to be substantially aligned with one another when the pivots 19 are secured to the foot lever 18. A pivot shaft 22, having a pair of opposite threaded ends, is received through each aligned aperture 21. The ends of the pivot shaft 22 extend outwardly of the apertures 21; and positioned thusly, the pivot shaft 22 is capable of free rotation in the apertures 21 to thereby provide a pivot axis.

Received on each respective end of the pivot shaft 22, inwardly of the threaded ends and outwardly of the pivots 19, is a rotatable pivot wheel 23. Each pivot wheel 23 rotates about the pivot axis provided by the pivot shaft 22. Moreover, each pivot wheel 23 is slidably, pivotably received in a respective channel 17 of each of the channel guides 16. In this fashion, horizontal adjustability of the foot lever 18 (and, as will be discussed later, the lower end of the extension rod 28) in the channel guides 16 may be effected. This permits the foot lever 18 to pivot about the pivot shaft 22, such that downward movement of the second, opposite end of the foot lever 18 moves the first end upwardly, and further such that downward movement of the first end of the foot lever 18 moves the second opposite end upwardly.

Positioned as described above, when disposed in the channel guides 16, the threaded ends of the pivot shaft 22 extend transversely through the respective longitudinal slots 17 in the channel guides 16 and extend outwardly therefrom. A wing nut 24 is threadably received on each respective end of the pivot shaft 22, outwardly of the channel guides 16. Positioned thusly, longitudinal movement of the pivot shaft 22 is restrained by the wing nuts 24 and lateral movement of the pivot shaft is restrained by the slots 17.

Secured to the second, opposite end of the foot lever 18 is a pedal 25 for receiving the downward force of the foot thereon. Pedal 25 is secured to the second, opposite end of the foot lever 18 by a one-way hinge 26 which is secured therebetween. Secured thusly, the downward movement of the pedal 25 moves the second, opposite end of the pedal downwardly therewith. The hinge 26 also permits the pedal 25 to be moved upwardly, independently of the foot lever 18 to facilitate cleaning of the floor 4 which is located thereunder.

Pivotably secured to the first end of the foot lever 18 is a cup 27 having a cylindrical aperture 27A formed therein. The cup 27 further includes a lower portion boss portion 27B having a transverse aperture 27C formed therethrough. The lower portion 27B is received in a notch 18A which is formed in the first end of the lever 18. A lateral bore 18B is formed through the first end of the lever 18, communicating with the notch 18A. When the cup 27 is disposed in the notch 18A, a pin 18C is disposed through the lateral bore 18B in the foot lever 18 and the transverse aperture 27C in the cup 27. In this manner, the cup 27 is pivotably secured to the first end of the foot lever 18, for concomitant pivotal movement therewith.

Received in the pivotably secured cup 27 is the lower end of a vertical extension rod (tube or pipe) 28. Positioned thusly, the rod 28 moves vertically upwardly and downwardly in response to the concomitant movement of the cup 27. Further, the rod 28 may be subjected to horizontal adjustable movement in response to the concomitant movement of the cup 27. It should be noted that the pivotal action of the cup 27 permits the rod 28 to be maintained on substantially the same vertical longitudinal axis throughout the vertical movement of the lever 18 and the cup 27. Preferably, the rod 28 has a coupling 28A including cooperating male and female threads; such that in a retrofit kit, an elongated rod 28 may be provided, having sufficient length for all installations, and the rod 28 may then be cut off to its desired size and adapted (by means of the threaded coupling 28A) to the particular installation.

Positioned in the upper portion of the lower housing 11, above the lower parallel channel guides 16, near the cover 14 are a pair of upper parallel channel guides 29. Guides 29 are supported on the upper edges of the sidewalls 13 and on an attachment lip 33 which is integral with one of the sidewalls 13 (as shall be discussed later). Each of the guides 29 has a notch 30 formed therein along the entire length of the guide 29. When positioned in the housing 11, the notches 30 are oriented towards one another, defining a channel therebetween.

Disposed in the channel defined between the channel guides 29 and supported thereby, is a sliding plate 31. Plate 31 may be formed from plastic, rubber or any other suitable material. The plate 31 has an aperture 32 (preferably an elongated aperture) formed therein, through which the extension rod 28 is received. In this manner, plate 31 acts as a boot or guard to maintain stability of the extension rod 28, and to provide a dust cover.

Figure 2:
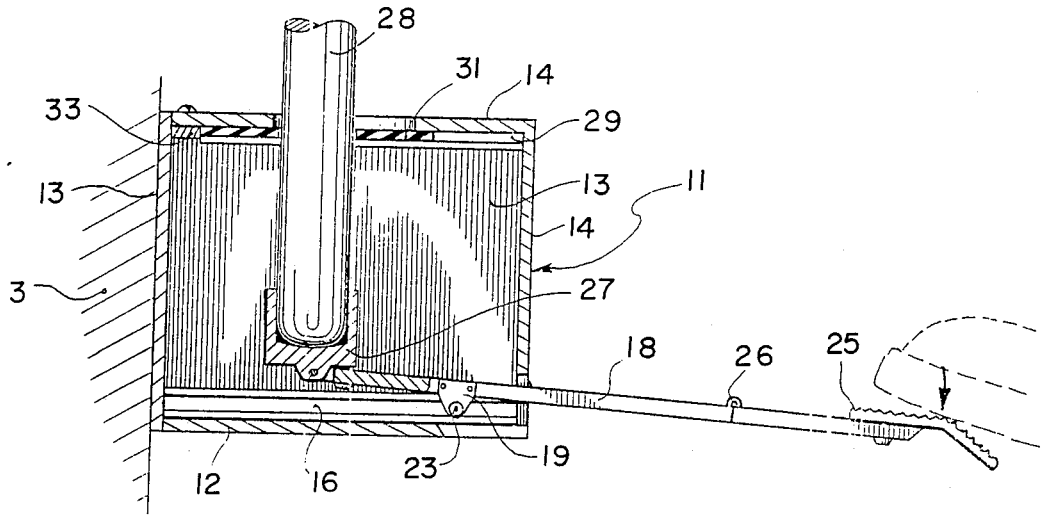
FIG. 2 is a cross-sectional view, taken along lines 2—2 of FIG. 1 and drawn to an enlarged scale, and illustrating the pivotably-mounted foot lever on the lower housing.
Figure 2A:
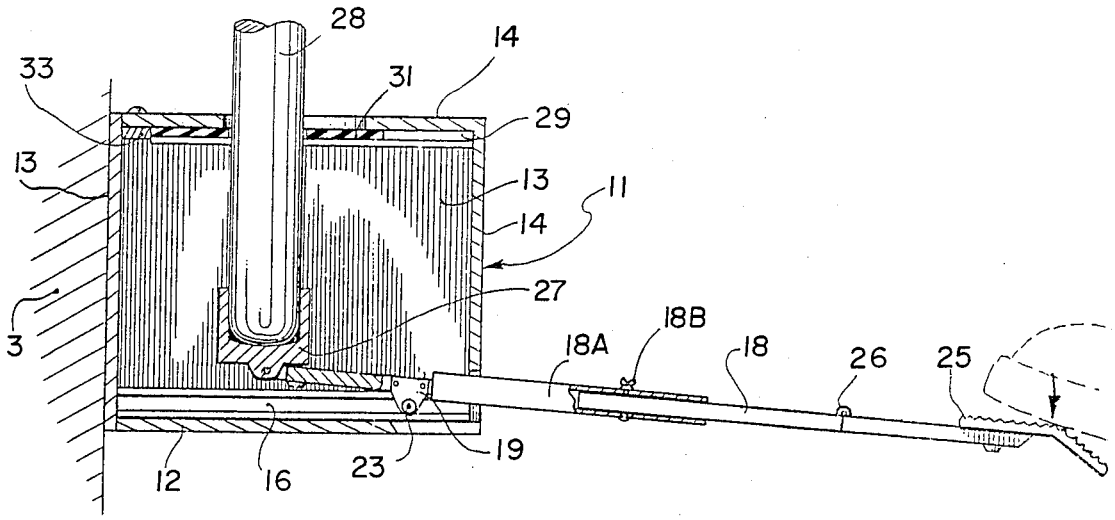
FIG. 2A is a portion of FIG. 2, showing an alternate embodiment having an intermediate sliding telescopic piece on the foot lever.
Figure 3:
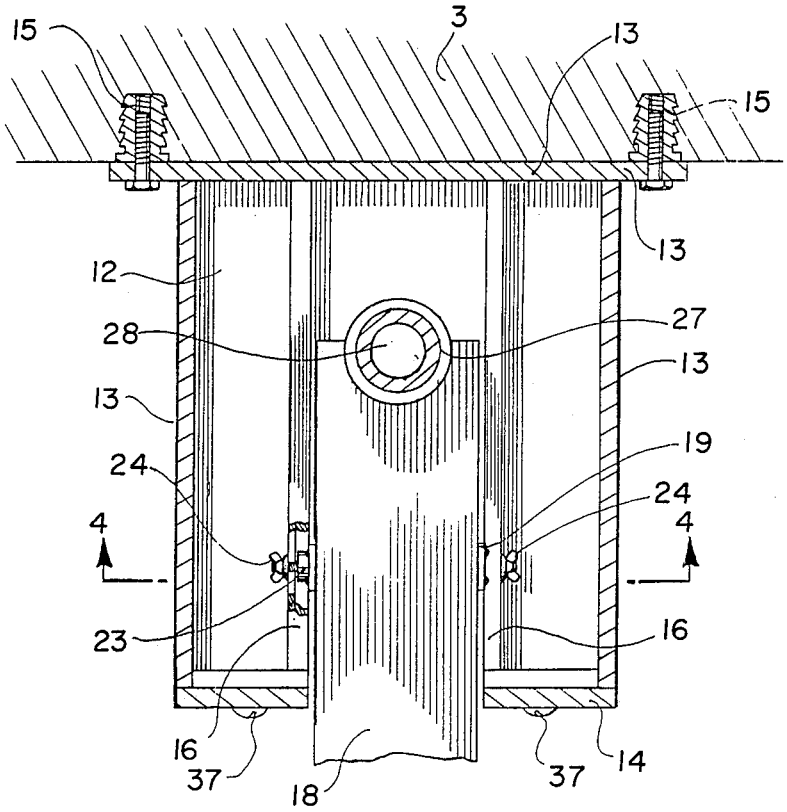
FIG. 3 is a further cross-sectional view, taken along lines 3—3 of FIG. 1 and drawn to an enlarged scale, and further illustrating the mounting of the pivoted foot lever in the lower housing.
Figure 4:
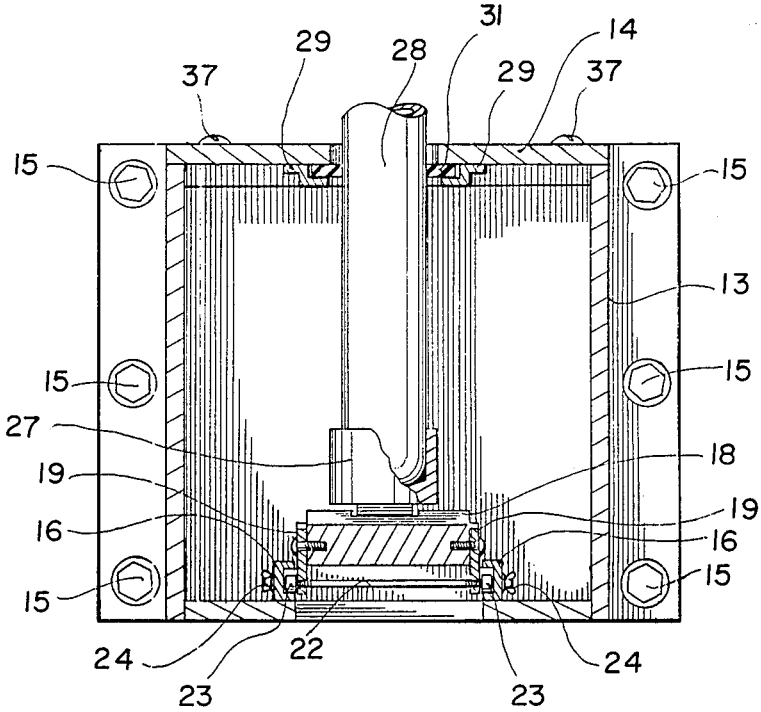
FIG. 4 is a cross-sectional view thereof, taken along lines 4—4 of FIG. 3.

If desired, the cover 14 may be substantially L-shaped and may be removably secured to the lower housing 11. This removability permits easy and ready access to the workings of the apparatus 10 located in the housing 11. When disposed on the lower housing 11, the cover 14 is received on a lip 33 (as shown in FIG. 2) which is integral with the rear sidewall 13 of the lower housing 11. The cover 14 is further received over the two other sidewalls 13 and is supported thereon, as shown in FIG. 4. Further, the cover 14 abuts and rests against a pair of cover attachment lips 34 which are integral with the bottom 12 and/or one of the other sidewalls 13, as shown in FIG. 5. Lip 33 has, preferably, three equally-spaced threaded apertures 35 formed therein. Lips 34 each have, preferably, one threaded aperture 35 formed therein. Similarly, apertures 36 are formed in the cover 14, so that when the cover 14 is disposed on the housing 11 (as described above) each of apertures 36 is aligned with a respective threaded aperture 35 formed in the lips 33 and 34. A threaded screw 37 is removably received through each pair of aligned apertures, 35 and 36, for removably securing the cover 14 to the remainder of the housing 11.

The cover 14 has one aperture or slot formed therein on the side thereof so that the foot lever 18 may extend therethrough being substantially parallel to the floor 4. The cover 14 further has a second aperture formed therein on the top thereof, so that the extension rod 28 may extend vertically upwardly from the housing 11.

Figure 6:
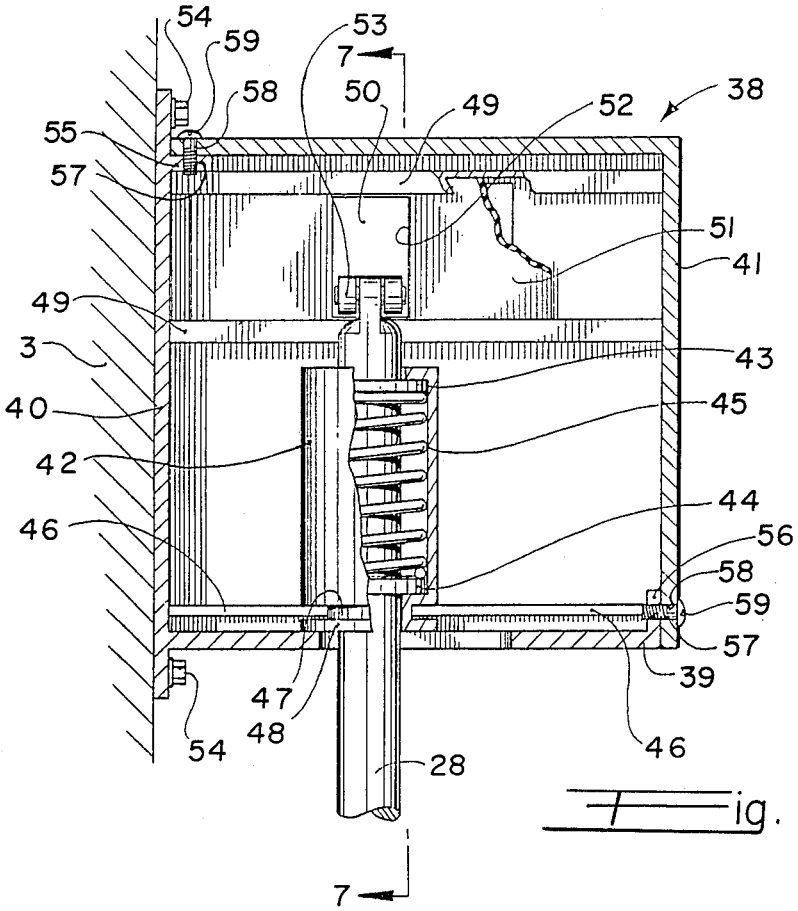
FIG. 6 is a cross-sectional view, taken along lines 6—6 of FIG. 1 and drawn to an enlarged scale, and illustrating the spring-loaded vertical rod within the upper housing.
Figure 7:
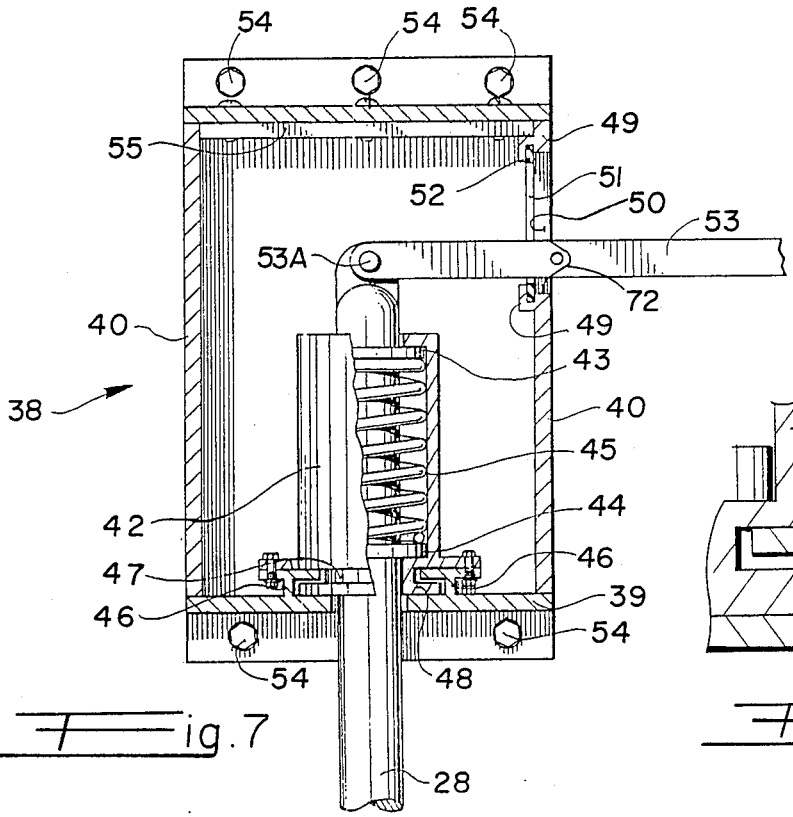
FIG. 7 is a cross-sectional view thereof, taken along lines 7—7 of FIG. 6.
Figure 7A:
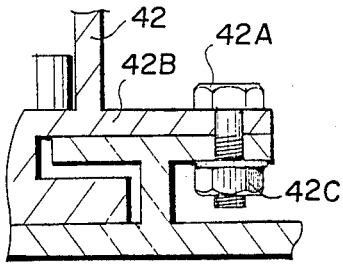
FIG. 7A is an enlarged portion of FIG. 7, showing the securing of the coil spring housing in its adjusted desired position.

Referring to FIG. 1 and further referring to FIGS. 6 and 7, an upper enclosed housing 38 is provided. Like lower housing 11, upper housing 38 has a bottom 39, sidewalls 40 and a removable cover 41, respectively. Positioned in the upper housing 38 is a cylindrical coil spring housing 42. Extending into the coil spring housing 42 is the extension rod 28, the upper end of which partially extends upwards therefrom. In the coil spring housing 42 (near where the rod 28 extends upwardly therefrom) a floating annular bearing plate 43 is positioned about the rod 28. Also positioned in the coil spring housing 42 (at the lower portion thereof) is a fixed annular bearing plate 44 which is carried by the extension rod for concomitant vertical upward and downward movement therewith. Also positioned in the coil spring housing 42 (between the floating bearing plate 43 and the fixed bearing plate 44) is a resilient coil spring 45.

Positioned thusly, the resilient coil spring 45 provides for constantly urging the extension rod 28 in a downward direction. In this fashion, when manual force is applied to the first end of the foot lever 18—moving the first end of the foot lever 18 downwardly, and the second opposite end of the foot lever 18 (with its cup 27 and the rod 28) concomitantly being moved upwardly—the biasing force of the spring 45 is overcome. Upon the cessation of such manual force or when the resilient biasing force of the spring 45 overcomes the manual force, the rod 28 is then moved downwards, returning the apparatus 10 to its original position.

The upper housing 38 has a pair of parallel channel guides 46 formed therein, being positioned on the bottom 39 thereof. The channels of each channel guide 46 are oriented towards one another, defining an open channel therebetween. The upper end of the extension rod 28 extends upwardly through the channel, between the channel guides 46, and into the coil spring housing 42. The lower end of the coil spring housing 42 has an annular groove 47 formed therein, thereby defining an annular collar 48 on the coil spring housing 42. The annular collar 48 is slidably received and guided in the parallel channel guides 46. In this fashion, horizontal movement of the upper end of the extension rod 28 (towards and away from the wall 3) is permitted. This accommodation further adds to the flexibility in adjusting the apparatus to fit various types of toilet room fixtures which are presently utilized, as well as adapting the apparatus of the present invention in the installation of new toilet bowls and urinals. Once the coil spring housing 42 is in its desired adjusted position, the coil spring housing 42 may be secured in place by bolts 42A which extend through ears 42B (on the housing 42) and engage respective nuts 42C.

The upper housing 38 further has a pair of parallel flush arm channels 49 formed therein in one of the sidewalls 40 thereof. An aperture 50 is defined in the sidewall 40 between the channels 49. A sliding cover plate 51 is slidably positioned in the channels 49. This cover plate 51 is preferably fabricated from plastic, rubber or any other suitable material. An aperture 52 is formed in the cover plate 51.

A flush arm 53 is partially positioned in the upper housing 38, and extends outwardly therefrom, being received through apertures 50 and 52 in the sidewall 40 and cover plate 51, respectively. Positioned thusly, the flush arm 53 is positioned on a longitudinal axis that is substantially perpendicular to the longitudinal axis in which the rod 28 is disposed.

Flush arm 53 has a first end which is located in the upper housing 38. The flush arm 53 has a second opposite end which is located outside the housing 38. The first end of the flush arm 53 is pivotably secured to the upper end of the extension rod 28 by means of pivot 53A. In this fashion, upward movement of the upper end of rod 28 moves the first end of the flush arm 53 concomitantly therewith. The flush arm 53 is also slidably guided within the slotted apertures 50 in sidewall 40 for movement therein. This once again provides to the flexibility in adjusting the apparatus 10 to fit various types of toilet room fixtures by providing the flush arm 53 with support over a wide range of motion. If desired, the sidewall 40 of the upper housing 38 may be removably mounted for maintenance purposes.

Figure 11:
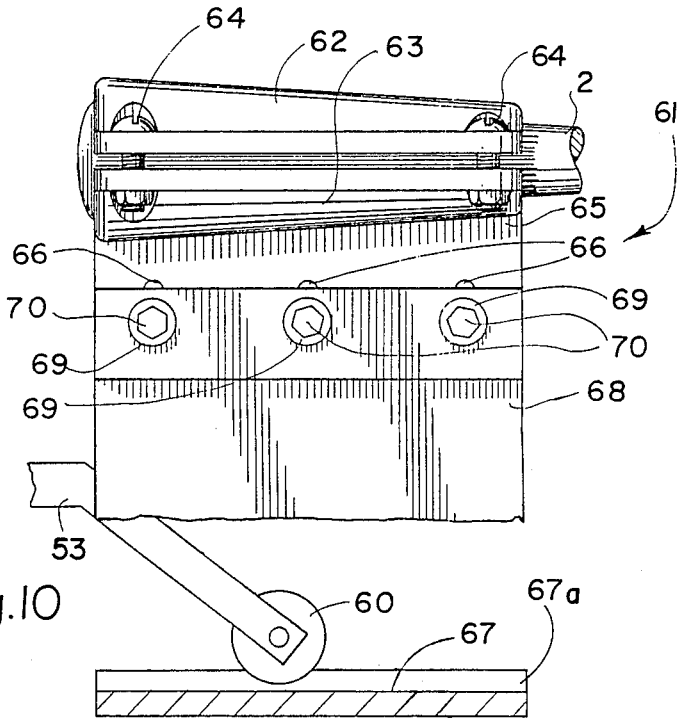
FIG. 11 is a front elevational view thereof, in partial cross-section, and taken along lines 11—11 of FIG. 10.
Figure 12:
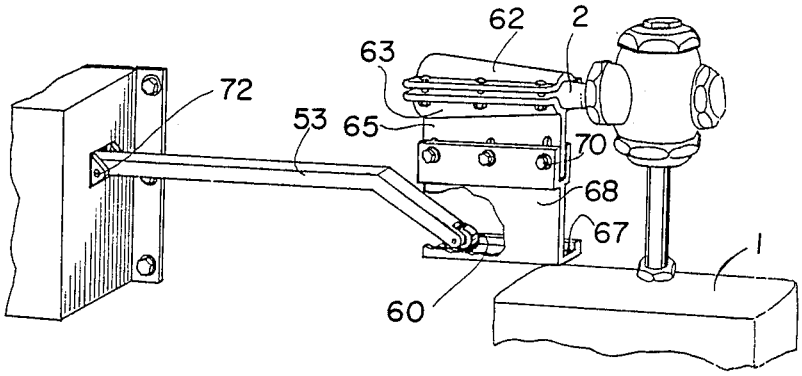
FIG. 12 is a perspective view thereof, with parts broken away for the sake of clarity, of the preferred embodiment of the flush arm of the present invention, showing its cooperation with the bracket assembly which is adjustably secured to the flush valve handle.

With reference to FIGS. 11 and 12, the flush arm 53 further has a second opposite end on which at least one rotatable wheel 60 is carried.

Like the lower housing 11, the upper housing 38 is secured to the wall 3 by bolts (or anchors) 54. Also, like lower housing 11, the cover of the upper housing 38 (and/or one or more sidewalls) are removable from the remainder of the housing 38. This removability permits easy and ready access to the workings of the apparatus 10 located in the housing 38. When disposed on the housing 38, the cover 41 is received on a cover attachment lip 55 which is integral with one of the sidewalls 40. The cover 41 is further received over the two other sidewalls 40, being supported thereon. Further, the cover 41 abuts and rests against a pair of cover attachment lips 56 which are integral with the bottom 39 and/or one of the other sidewalls 40. Lip 55 has, preferably, three equally-spaced threaded apertures 57 formed therein. Lips 56 each have, preferably, one threaded aperture 57 formed therein. Similarly, apertures 58 are formed in the cover 41, so that when the cover 41 is disposed on the housing 38 (as described above) each of apertures 58 is aligned with a respective threaded aperture 57 formed in the lips 55 and 56. A threaded bolt 59 is removably received through each pair of aligned apertures 57 and 58, for removably securing the cover 41 to the remainder of the housing 38.

It will be appreciated by those skilled in the art, however, that the accessibility to the lower housing 11 and upper housing 38 (herein disclosed) is only exemplary of one access means, and that other structural arrangements to provide accessibility—for convenient installation and/or maintenance—are equally feasible consonant with the teachings of the present invention.

Figure 10:
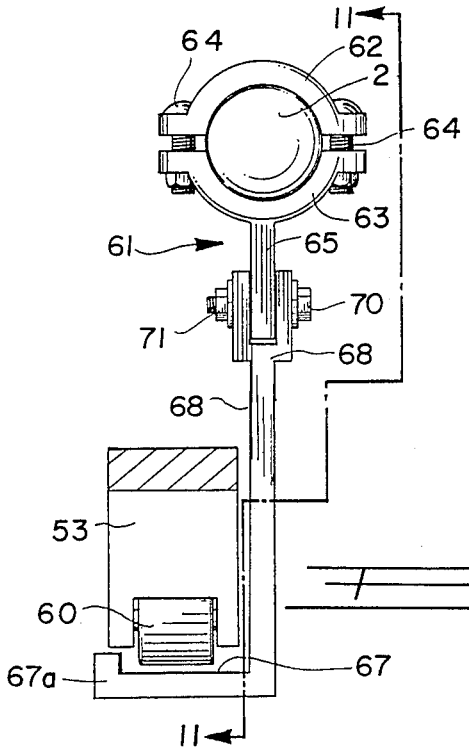
FIG. 10 is a side elevational view of a preferred embodiment of an adjustable bracket, illustrating its connection to the handle of a flush valve.

Referring again to FIG. 1, and referring further to FIGS. 10, 11 and 12, a bracket assembly 61 is secured to the flush valve handle 2. The bracket assembly 61 includes upper and lower split sleeves, 62 and 63, respectively. The sleeves 62 and 63 are positioned annularly about the flush valve handle 2 and are secured thereto, by bolts 64. A plate 65 is formed integrally with the lower split sleeve 63 and extends downwardly therefrom. Preferably, the plate 65 has at least a pair (and, preferably, three) elongated slots 66 formed therein.

Below the flush valve handle 2, in the lower portion of the bracket assembly 61, an open channel 67 is formed therein. This channel 67 is vertically adjustably secured to the plate 65 (depending from the lower split sleeve 63) by suitable means. The channel 67 includes an upwardly extending lip 68. Preferably, the lip 68 has at least a pair (and, preferably, three) apertures 69 formed therein. Apertures 69 and slots 66 are substantially aligned with one another (a shown more clearly in FIG. 11). A respective bolt 70 is received through each respective pair of an aperture 69 and a slot 66. A nut 71 is received on each bolt 70 for adjustably removably securing the channel 67 to the plate 65, whereby the channel 67 may be adjusted vertically relative to the flush valve handle 2. Together, the apertures 69, slots 66, screws 70 and nuts 71 provide a means for adjustably securing the channel 67 to the plate 65. In this fashion, the apparatus 10 once again provides the flexibility required in adjusting to fit various types of toilet room fixtures.

It is to be noted that while described above, alternatively, the slots 66 could have been formed in the lip 68, and the apertures could have been formed in the plate 65, if desired.

Formed as described above, the second, opposite end of the flush arm 53 is received within the lower portion of the bracket assembly 61 and carries a wheel 60 rotatably guided in the channel 67. As shown more clearly in FIG. 10, wheel 60 has a lateral clearance (on both sides thereof) with respect to the channel 67 and a lip 67A formed thereon, and (preferably) further has a vertical clearance with respect to the bottom of the channel 67. These clearances may be in the order of one-half inch. This arrangement provides for slidability within the channel 67 with low friction and with high leverage efficiency, which provides for more efficient flushing movement.

In this fashion, upward movement of the first end of the flush arm 53 pivotably moves the second, opposite end of the flush arm 53 downwardly, concomitantly moving therewith the bracket assembly 61 (and the flush valve handle 2 secured thereto) downwardly. This downward motion results in activation of the flush valve handle 2, flushing matter from the urinal 1 or other toilet room fixture.

This structural arrangement provides sufficient leverage while minimizing the possibility of "jamming", that is, there is less tendency (after activation of the flush valve handle 2) for the handle 2 to "hang up", the effect of which would be to have the water running continuously in the urinal 1.

With the preferred structural arrangement of FIG. 12, the flush arm 53 includes a pivot (a second pivot) 72 located (between the two ends thereof and the second opposite end of the flush arm 53 is angled downwardly.

Figure 8:
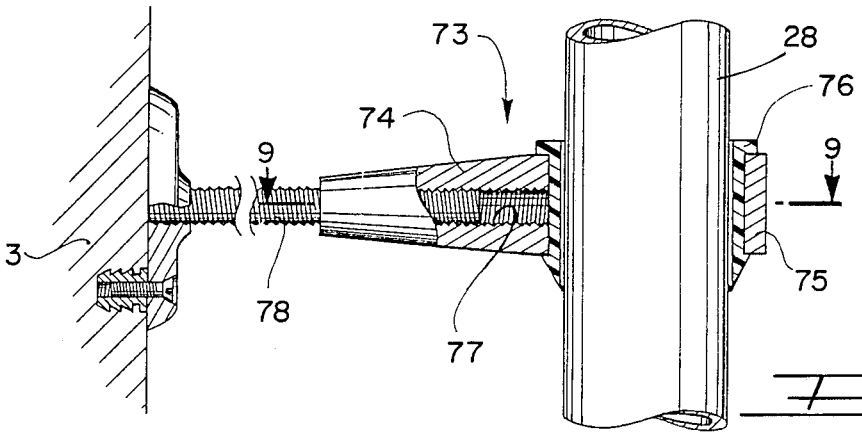
FIG. 8 is a further cross-sectional view, taken along lines 8—8 of FIG. 1 and drawn to an enlarged scale, and illustrating the adjustable mounting of the slidable vertical rod to the adjacent wall.
Figure 9:
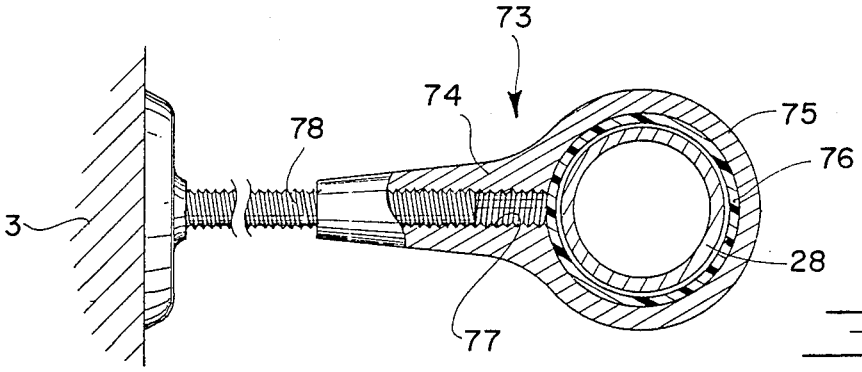
FIG. 9 is a cross-sectional view thereof, taken along lines 9—9 of FIG. 8.

Referring to FIGS. 8 and 9, (in addition to FIG. 1) at least one (and preferably two) spaced bearing brackets 73 are provided for supporting and slidably guiding the rod 28 at an adjustable distance from the wall (or other support) 3.

Each bearing bracket 73 has a body 74 including an end portion which is adjustably secured to the wall 3, so that the secured bearing bracket 73 extends horizontally from the wall 3. The body 74 also has an opposite end from the wall 3 which has a ring 75 formed therein. A bearing sleeve 76 is secured within the ring 75. In this fashion, the rod 28 is snugly guided and supported for relative friction-free vertical sliding movement. This provides further strength to the apparatus of the present invention.

Finally, means is provided for adjustably securing the bearing bracket 73 to the wall 3. The body 74 has an internally threaded tapped recess 77 formed therein. A threaded rod 78 having two ends is provided. One end of the rod 78 is secured to the wall 3. The second, opposite end of the threaded rod 78 is threadably received in the tapped recess 77. By threading and unthreading the rod 78 from the tapped recess 77, the distance between the bracket 73 and the wall 3 may be horizontally adjusted. This, once again, provides the apparatus 10 of the present invention with greater flexibility in being adapted to be utilized with conventional toilet room fixtures.

Figure 13:
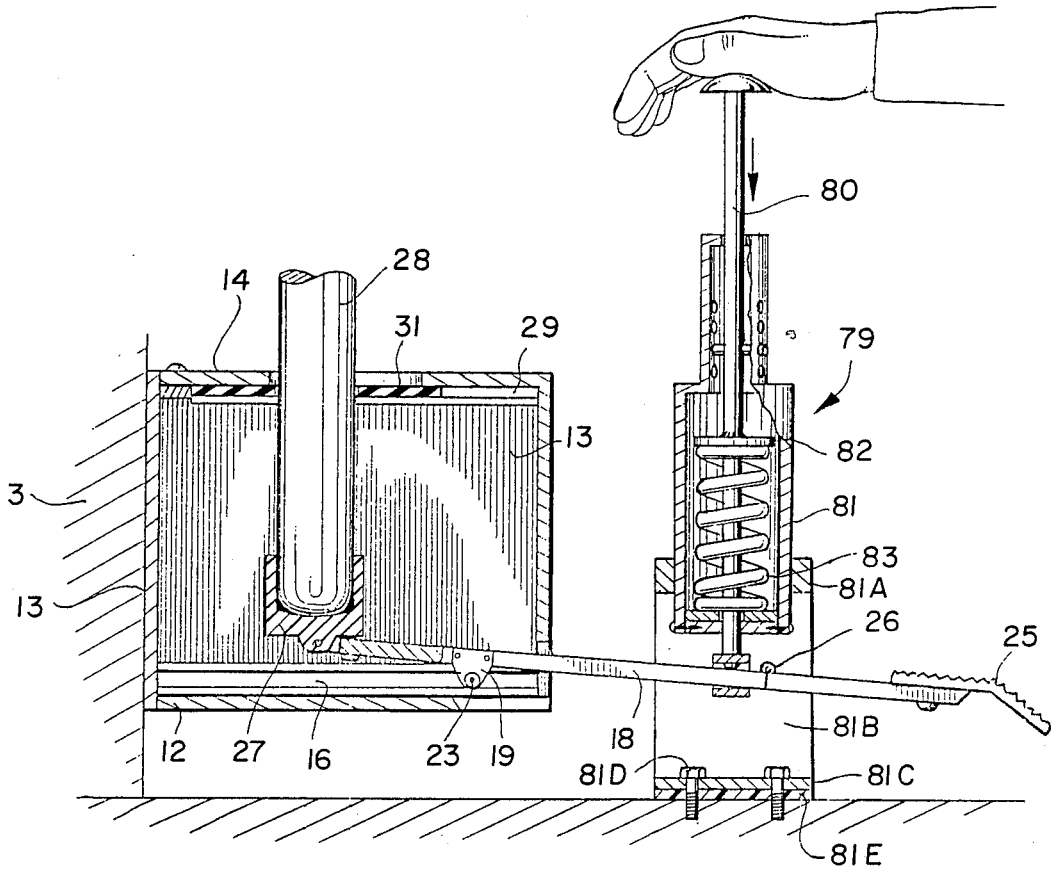
FIG. 13 is a side elevational view, corresponding substantially to FIG. 2 and with parts broken away and sectioned, of the vertical rod, lower housing, and pivoted foot lever of the present invention; wherein a manual plunger is installed so that the foot-activated device may also be manually activated by a handicapped person; and wherein the installation is intended primarily for toilet compartments designated for the handicapped.

With reference to FIG. 13, an alternate embodiment of the apparatus 10 of the present invention is illustrated, wherein the apparatus 10 is further provided with a plunger 79, whereby manual force may be applied to the second, opposite end of the foot lever 18 for moving said lever. The plunger 79 has a lower end which is suitably secured about the lever 18. A plunger shaft 80 is slidably disposed in a housing 81 extends from both ends thereof. The shaft 80 has a fixed annular bearing plate 82 secured on the upper end of the shaft 80 in the housing 81. A resilient coil spring 83 is disposed in the housing 81, between the lower end of the housing 81 and the fixed bearing plate 82. This resilient coil spring 83 constantly urges the shaft 80 into its upward position, wherein force is removed from the lever 18. Manual downward force on the shaft 80 overcomes the biasing action of the spring 83, thereby moving the shaft 80 downwardly into contact with the second, oppositely of the end of the lever 18, and thereby applying force to the foot lever 18 to move the lever 18 downwardly so as to activate the flush valve handle 2 (as described above). Preferably, the plunger housing 81 is supported in a ring 81A carried by a bracket 81B having a horizontal lip 81C secured to the floor 4 by bolts 81D. Preferably, a plastic plate 81E is disposed between the lip 81C and the floor 4 for cleanliness purposes. This embodiment, which is particularly useful for handicapped persons, may be optionally installed in toilet compartments designated specifically for handicapped persons.

If desired, a sign could be posted above the urinal (or toilet bowl) stating: "FOR SANITARY PURPOSES PLEASE USE FOOT PEDAL TO ACTIVATE FLUSHING THIS FIXTURE".

It will also be appreciated by those skilled in the art, that the flush valve handle 2 is itself spring loaded (internally of the urinal fixture) and will tend to return to its normal "at rest" position. This is particularly helpful in the preferred embodiment of FIG. 12.

It will also be appreciated that the foot lever actuated apparatus of the present invention further provides a mechanical advantage, making flushing easier.

Figure 14:
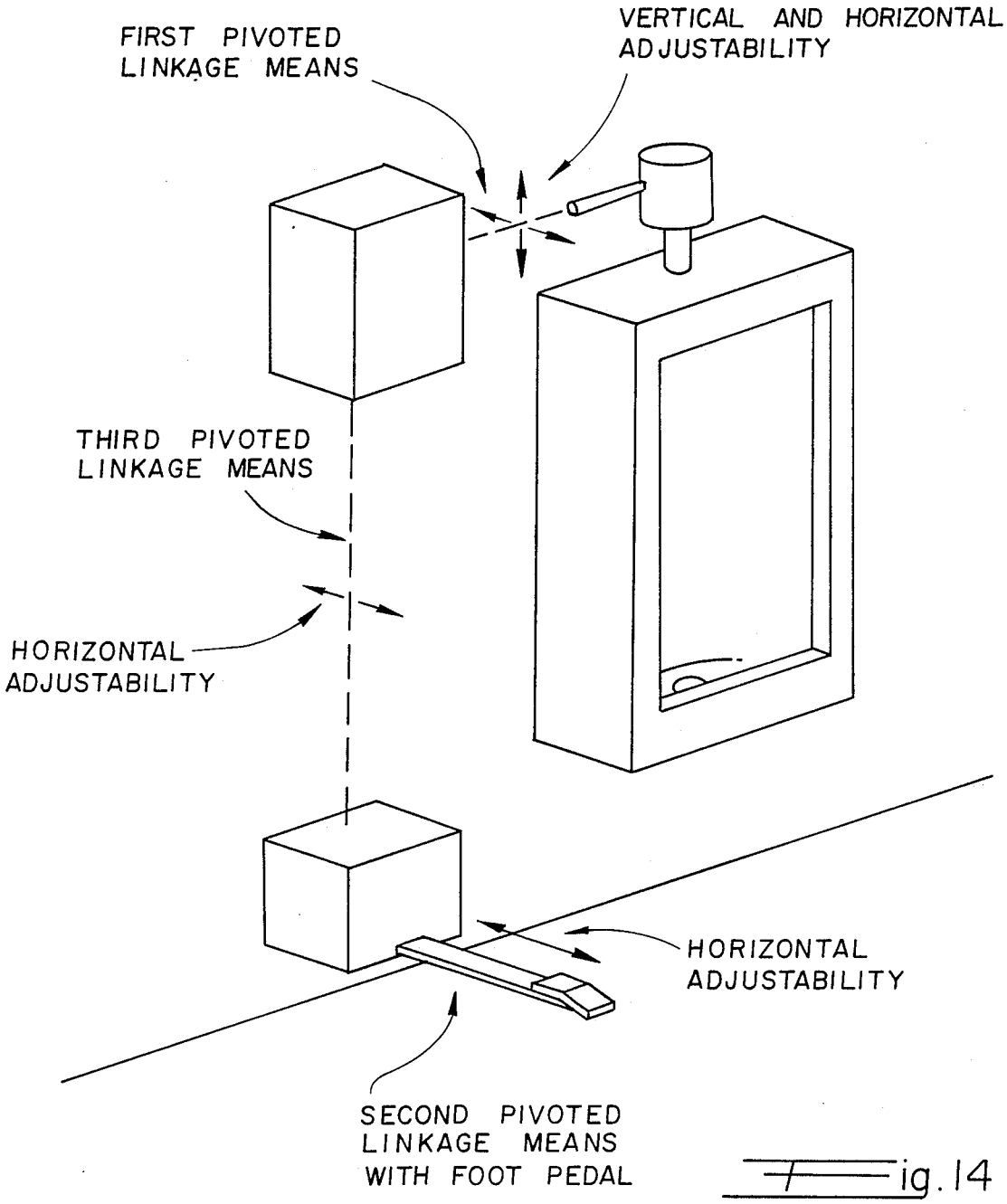
FIG. 14 is a schematic perspective of the apparatus of the present invention, showing its inherent utility, adjustability, and adaptability to existing urinal installations.
Figure 15:
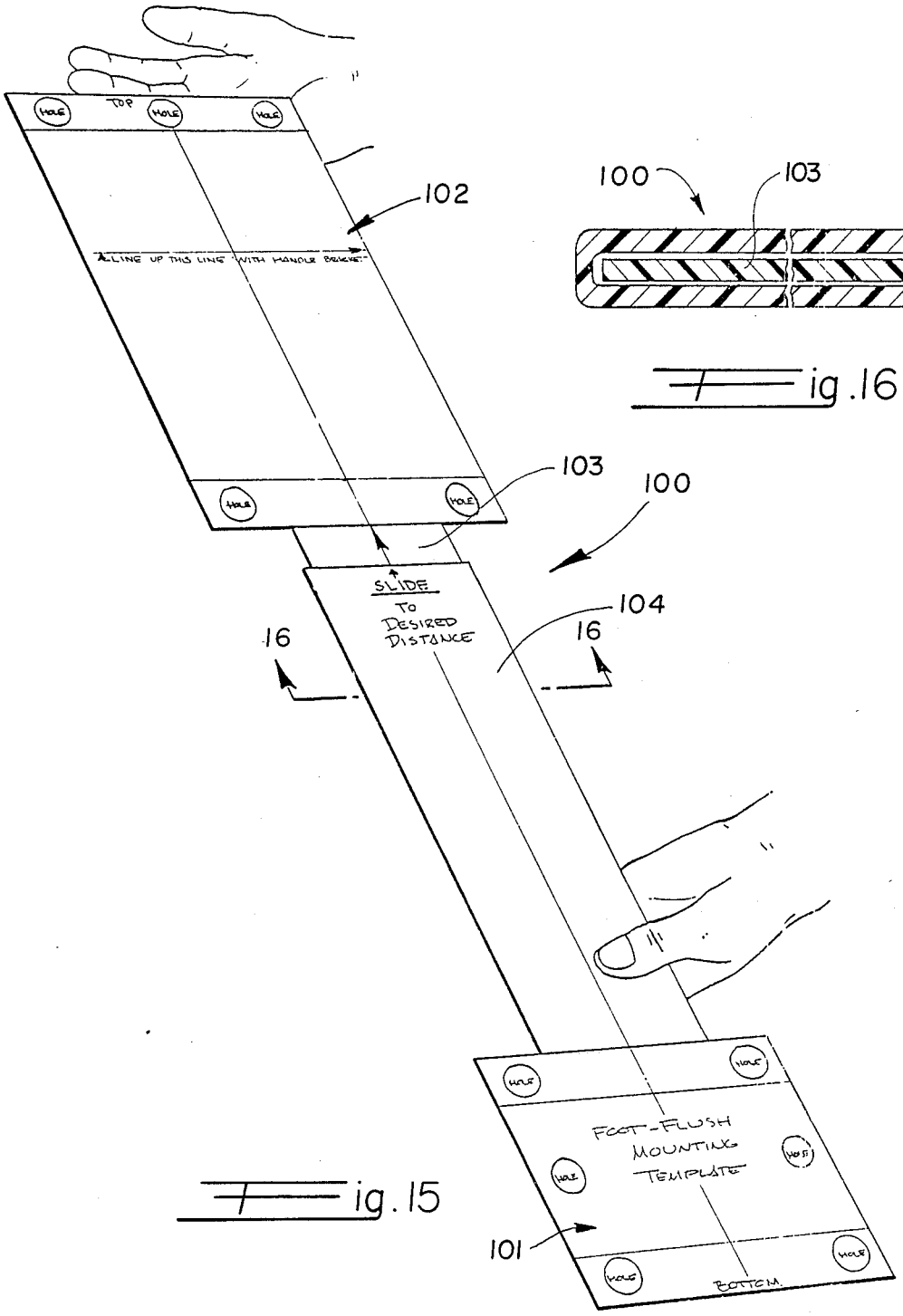
FIG. 15 is a perspective view of a template for convenient use in installing the adjustable apparatus of the present invention.
Figure 16:
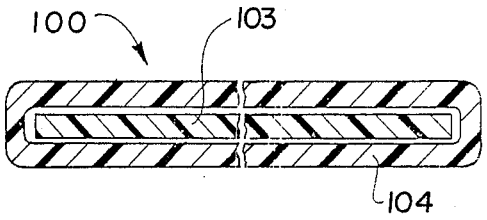
FIG. 16 is a cross-sectional view thereof, taken along the lines 16—16 of FIG. 15, and illustrating the plastic material used in the template.

The inherent utility of the apparatus of the present invention, and its flexibility and adaptability to various existing (or new) installations in toilet rooms, will be readily appreciated from the schematic illustration of FIG. 14.

By providing a unique degree of inherent adjustability and flexibility, the apparatus of the present invention is readily adapted to a wide variety of toilet room fixtures and installations, both new and existing. For example the AMERICAN STANDARD fixtures have a range of dimensions, as follows:

| | Min. (inches) | Max. (inches) |
|---|---|---|
| Height of flush valve from the floor to the center line of the flush valve handle | 21½ | 54¾ |
| Center line of flush valve to the wall | 2¼ | 4½ |
| Distance of front edge of fixture to the wall | 11¼ | 29½ |

Nevertheless, the apparatus of the present invention readily accommodates this wide spectrum of fixtures and installations, and thus it will be appreciated by those skilled in the art that the apparatus of the present invention is indeed valuable for use with new or existing toilet room fixtures.

With reference to FIGS. 15–20, there is illustrated the preferred sequence for locating the mounting holes (in the wall laterally of the urinal) for subsequently securing the apparatus of the present invention to the wall. For this purpose, a template 100 is provided; as shown more clearly in FIGS. 15 and 16, the template 100 is relatively thin—preferably being molded of vinyl or other plastic material—and is elongated and somewhat flexible. The template 100 has a lower locating portion 101 and an upper locating portion 102 (for locating the lower housing 11 and upper housing 38, respectively, relative to the wall 3). Upper locating portion 102 carries a depending tongue portion 103 which is slidably guided within an upwardly extending channel portion 104 carried by the lower locating portion 101, thereby telescoping the upper locating portion 102 relative to the lower locating portion 101, and thereby providing for vertical adjustability of the template 100 for various urinal installations within a given range.

Figure 17:
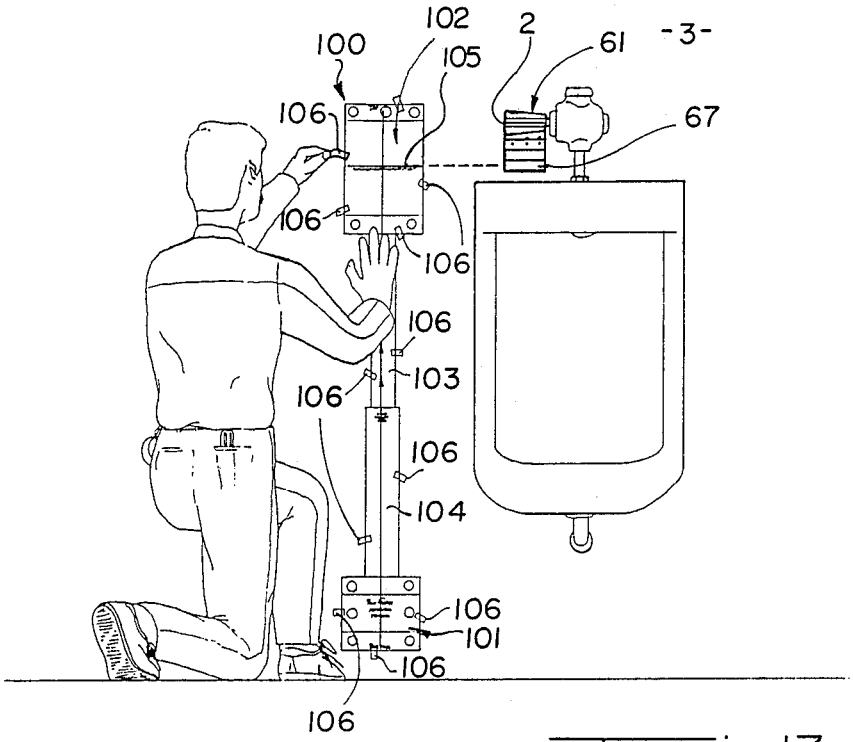
FIG. 17 is a perspective view illustrating the use of the template for marking off and locating the mounting holes adjacent to a wall-mounted urinal.

As shown more clearly in FIG. 17, the upper locating portion 102 has a scribe line 105 which (in using the template) is aligned with the bottom of the channel 67 in the bracket assembly 61 (which is vertically, adjustably mounted to the flush valve handle 2). Thereafter, once the template 100 has been so located, the template 100 may be temporarily held on to the surface of the wall 3 by tapes 106 (or other suitable means).

Figure 18:
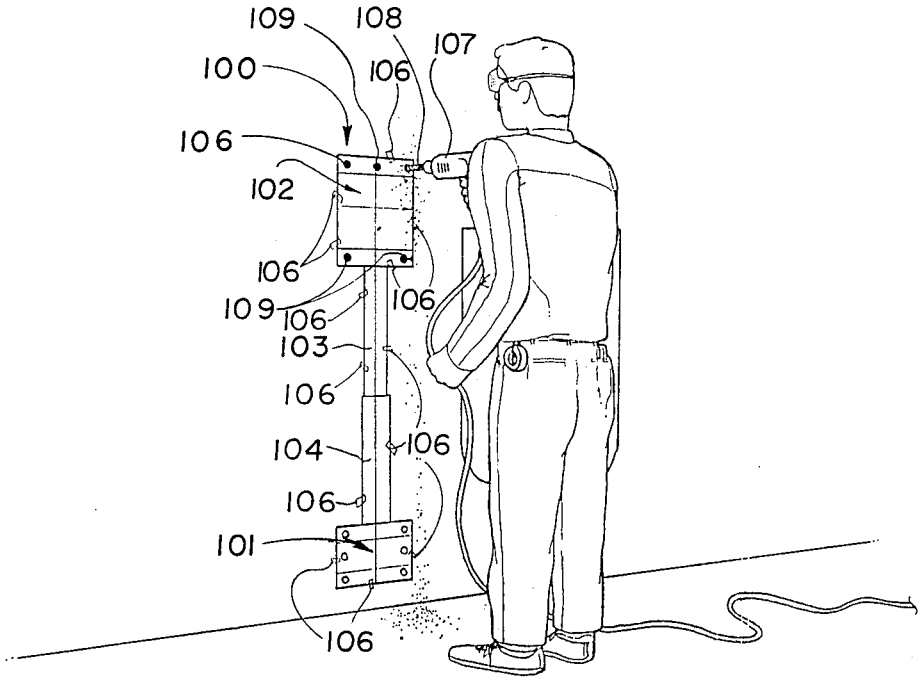
FIG. 18 corresponds to FIG. 17, but illustrates the use of the template in drilling the mounting holes for the adjustable apparatus of the present invention.

Once the template 100 has been properly aligned (and temporarily secured to the wall 3) the mounting holes may be drilled into the wall, as shown more clearly in FIG. 18, using a portable electric hammer-drill 107 having a carbide bit 108 (or other suitable tool).

Figure 19:
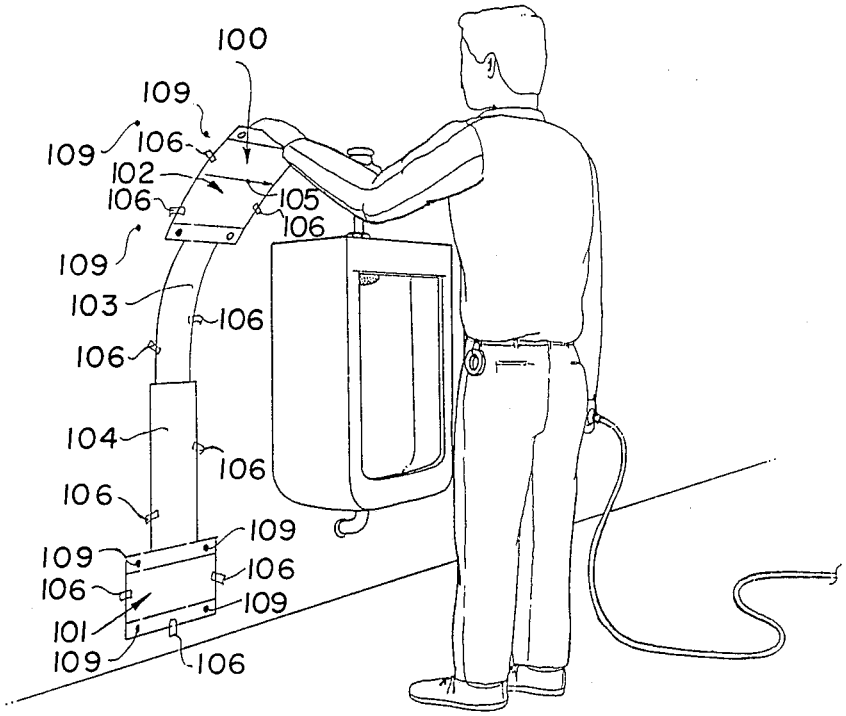
FIG. 19 further illustrates the removal of the template after the mounting holes have been drilled in the wall.
Figure 20:
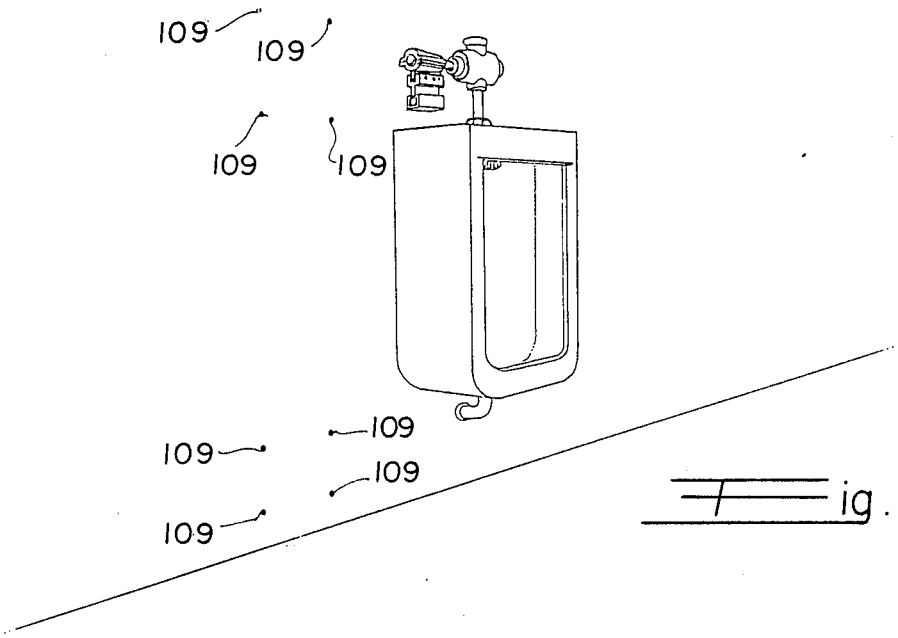
FIG. 20 further illustrates the mounting holes in the wall, thereby facilitating the mounting of the adjustable apparatus of the present invention.

Thereafter, once the mounting holes 109 are drilled into the wall 3, the template 100 may be quickly stripped off the wall, as shown more clearly in FIG. 19, thereby leaving the mounting holes 109 in the wall 3 as shown in FIG. 19.

Use of the template 100 saves valuable time in installation of the apparatus 10 of the present invention. The entire apparatus 10 may be installed quickly and conveniently in existing toilet room facilities in schools, offices, public buildings, transportation terminals, barracks, and other structures especially where a relatively large number of people congregate. The installation is simple and easy, using conventional tools and simple instructions, and complicated code approvals are unnecessary.

Accordingly, the apparatus of the present invention fulfills a long-felt need for a simple, practical and relatively inexpensive means for flushing a urinal or toilet bowl by means of the user's foot. Hand contact with the flush valve handle is obviated, sanitary conditions are substantially improved, and inadvertent contamination and the spread of disease from one user to another is substantially obviated.

Figure 21:
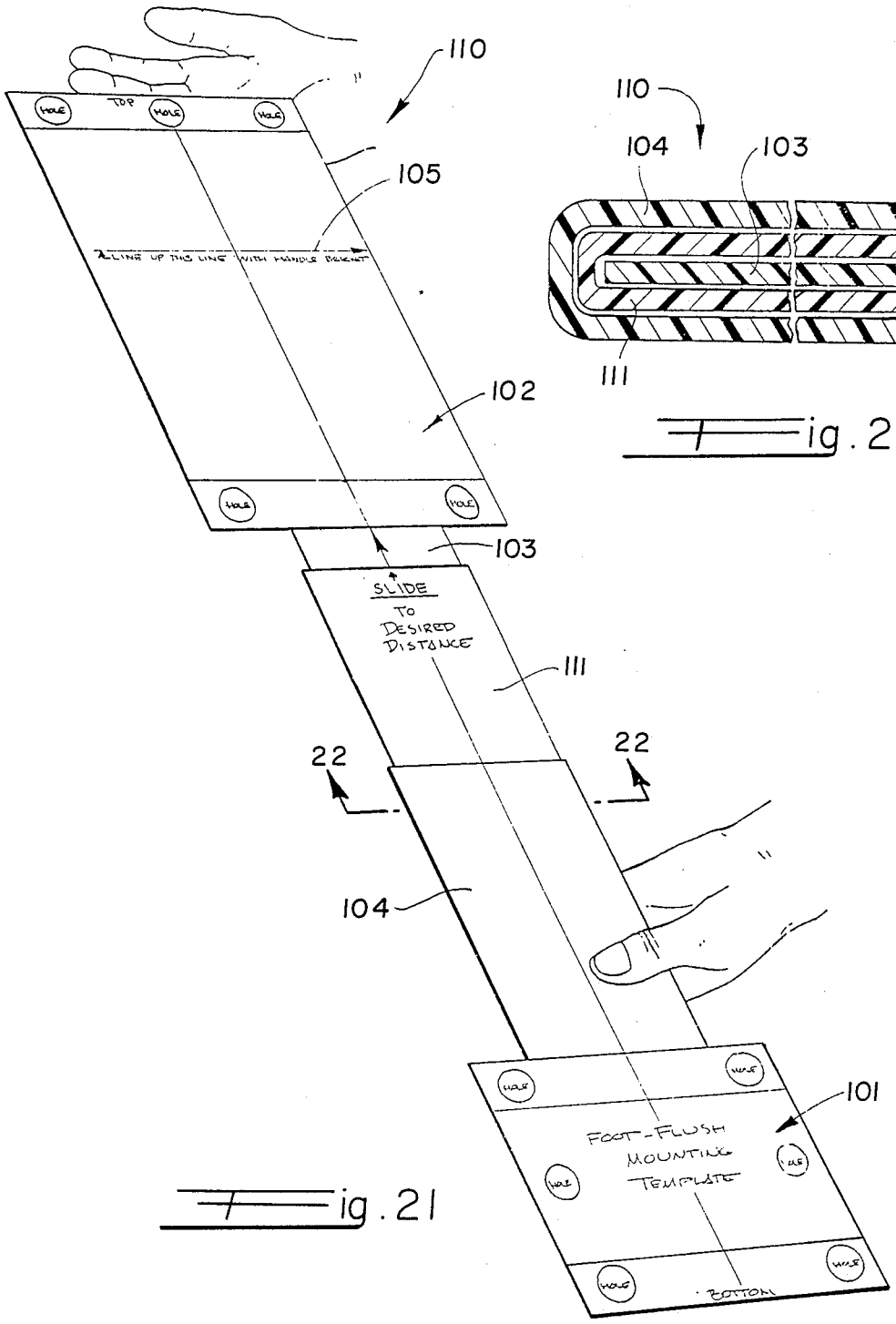
FIG. 21 is a perspective view of a modified template, corresponding substantially to FIG. 15, but illustrating an intermediate telescopic piece for increased flexibility.
Figure 22:
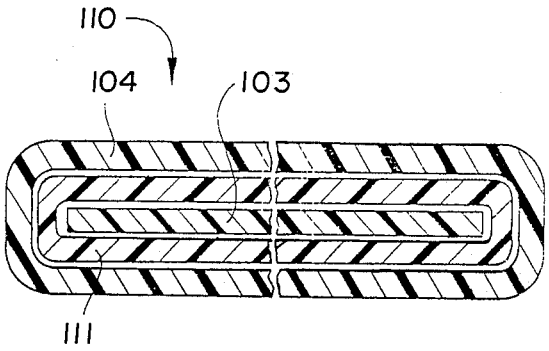
FIG. 22 is a cross-sectional view thereof, taken along the lines 22—22 of FIG. 21.

FIGS. 21 and 22 illustrate an alternate template 110 having an intermediate piece 111 slidably fitted between the upper locating portion 102 and the lower locating portion 101; this template 110 provides additional adjustability and flexibility.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An apparatus for activating a flush valve handle, comprising:

a lower housing having a bottom, sidewalls and a cover;

a pair of lower parallel channel guides positioned on the bottom in the lower housing, said guides further positioned having the channels thereof oriented facing one another, a pair of slidable foot lever pivots, each pivot having a respective pivot portion, each pivot portion slidably received in a respective channel formed in the lower channel guides;

a foot lever positioned in the lower housing between the pivots and extending outwardly therefrom, the foot lever having a first end positioned in the lower housing and a second opposite end positioned outside the lower housing for receiving downward force thereon;

the foot lever being secured to each slidable pivot, whereby the foot lever pivots about the pivot portion, such that downward movement on the second opposite end of the foot lever moves the first end upwardly, and such that downward movement of the first end moves the second end upwardly, and further whereby the foot lever is horizontally adjustable in the lower channel guides;

a cup pivotably secured to the first end of the foot lever for concomitant pivotal and slidable movement therewith;

an extension rod having a lower end received within the pivotably secured cup in the lower housing for vertical upward and downward movement in response to the concomitant movement of the cup and for horizontal adjustable movement in response to the concomitant movement of the cup;

an upper housing having a bottom, sidewall and a cover;

a coil spring housing positioned in the upper housing;

a resilient coil spring positioned in the coil spring housing;

the extension rod further having an upper end including a fixed bearing plate annularly extending therefrom, the upper end received in the coil spring housing with the coil spring being positioned between the spring housing and the bearing plate and constantly urging the extension rod vertically downward;

a flush arm positioned in the upper housing and extending outwardly therefrom, substantially perpendicular to the extension rod, the flush arm having a first end located in the upper housing and a second opposite end located outside of the housing, the first end being pivotably secured to the upper end of the extension rod, such that upward movement of the upper end of the extension rod moves the first end of the flush arm concomitantly therewith;

wherein the flush arm is pivotally mounted to the upper housing between the first and second opposite ends of said flush arm;

a bracket adapted to be secured to the flush valve handle, the bracket having a lower portion positioned below the flush valve handle, said lower portion having a channel formed therein; and the second opposite end of the flush arm having at least one rotatable wheel carried thereon, said second opposite end of the flush arm being received within the lower portion of the bracket and having the rotatable wheel rotatably guided in the channel, such that upward movement of the first end of the flush arm pivotably moves the second opposite end of the flush arm downwardly, concomitantly moving the bracket having the flush valve handle secured thereto, whereby the flush valve handle is activated.

2. The apparatus of claim 1, further comprising:

a pedal for receiving downward force of a foot thereon; and a one-way hinge secured to the second opposite end of the foot lever and to the pedal, such that downward movement of the pedal moves the second opposite end of the pedal downwardly therewith, and such that the pedal may be swung about the hinge and folded back upon the foot lever.

3. The apparatus of claim 1, further comprising a plunger, the plunger having an upper end to receive manual force thereon, the plunger further having a lower end joined to the second opposite end of the foot lever, such that downward movement of the plunger moves the second opposite end of the pedal downwardly therewith, thereby accommodating the apparatus for handicapped persons.

4. The apparatus of claim 1, wherein the pivot portion of each respective foot lever pivot includes a pivot wheel rotatable about a pivot axis extending outwardly from the pivot.

5. The apparatus of claim 1, wherein the pivot portion of such respective foot lever pivot is further comprised of:

each pivot portion having an aperture formed therein below the foot lever, said apertures being aligned with one another;

a pivot shaft having a pair of opposite ends, said pivot shaft being received through each respective aligned aperture extending therefrom; and a rotatable pivot wheel positioned on each respective end of the respective foot lever pivot shaft outwardly of the pivots, each wheel being slidably pivotably received in a respective channel of the parallel channel guides, whereby the foot lever and the lower end of the extension rod may be horizontally adjusted.

6. The apparatus of claim 1, further comprised of:

a pair of upper parallel channel guides, each channel guide having a notch formed therein along the length thereof, each upper channel guide positioned in the lower housing above the lower parallel channel guides having the notches oriented towards one another, thereby defining a channel therebetween; and a sliding plate disposed in the channel and supported by the upper parallel channel guides for sliding movement therein, the sliding plate having an aperture formed therein for

7. The apparatus of claim 1, further comprised of:

at least one bearing bracket;

means for adjustably securing the bearing bracket to a vertical wall, whereby the bearing bracket horizontally extends therefrom;

said bearing bracket having a ring formed therein opposite of the vertical wall;

a bearing sleeve annularly positioned in the ring; and wherein the extension rod is received through the ring and the bearing sleeve positioned therein, whereby the rod is supported and slidably guided therein at an adjustable distance from the wall.

8. The apparatus of claim 7, wherein the means for adjustably securing the bearing bracket to the vertical wall is comprised of:

the bearing bracket having an internally threaded recess formed therein; and a threaded rod having one end secured to the wall and a second opposite end threadably received in the internally threaded recess, whereby the bearing bracket may be adjustably positioned horizontally relative to the wall.

9. The apparatus of claim 1, further comprising:

the upper housing further having a pair of parallel channel guides positioned on the bottom thereof and having the channels thereof oriented towards each other defining a channel therebetween;

the coil spring housing having a lower end wherein an annular slot is formed, thereby defining an annular collar therebelow, the annular collar being slidably received and guided in the parallel channel guides positioned in the upper housing, whereby horizontal movement of the upper end of the extension rod is permitted for adjustment purposes; and means for securing the coil spring housing to the upper housing in its desired adjusted position.

10. The apparatus of claim 1, further comprising:

the upper housing further having a pair of parallel flush arm channels formed therein;

a sliding guide slidably positioned in the parallel flush arm channels, said sliding guide having an aperture formed therein; and the flush arm being received through the aperture formed in the guiding plate, whereby the flush arm is slidably guided for movement therein.

11. The apparatus of claim 1, wherein the flush arm is pivotably mounted relative to the upper housing, wherein the second opposite end of the flush arm has a portion which is angled downwardly, and wherein a wheel is carried by the downwardly-angled portion of the flush arm, the wheel being guided in the channel formed within the bracket which is carried by the flush valve handle.

12. The apparatus of claim 11, wherein the wheel has a lateral and a vertical clearance with respect to the channel.

13. The apparatus of claim 1, wherein the bracket is comprised of:

an upper and a lower split sleeve, each of said sleeves being secured to each other about the flush valve handle;

a plate integrally formed with the lower split sleeve and extending downwardly therefrom; and means for adjustably securing the channel to the plate opposite of the lower split sleeve.

14. The apparatus of claim 13, wherein the means for adjustably securing the channel to the plate is comprised of:

one of the plate or channel having at least a pair of apertures formed therein;

the other of the plate or channel having at least a pair of elongated slots formed therein;

a pair of bolts, a respective bolt being received through one of each a respective aperture and a respective slot; and a nut received on each bolt for securing the channel to the plate, whereby the channel may be adjusted vertically relative to the flush valve handle.

15. The apparatus of claim 1, wherein the pivot portion of each respective foot lever pivot is comprised of a pivot wheel rotatable about a pivot axis extending outwardly from the respective foot lever pivot, and wherein each said pivot portion includes an aperture formed therein below the foot lever, said apertures being aligned with one another;

a pivot shaft having a pair of opposite ends, said pivot shaft being received through each respective aligned aperture extending therefrom; and a rotatable pivot wheel positioned on each respective end of the said pivot shaft outwardly of the pivots, each pivot wheel being slidably pivotably received in a respective channel of the parallel channel guides, whereby the foot lever and the lower end of the extension rod may be horizontally adjusted.

16. The apparatus of claim 1, further comprised of:

at least one bearing bracket;

means for adjustably securing the bearing bracket to a vertical support, whereby the secured bracket horizontally extends therefrom;

said bearing bracket having a ring formed therein opposite of the support;

a bearing sleeve annularly positioned in the ring; and wherein the extension rod is received through the ring and the bearing sleeve positioned therein, being supported and slidably guided therein at an adjustable distance from the support; and wherein the means for adjustably securing the bearing bracket to the support includes the bearing bracket having an internally threaded recess formed therein, and a threaded rod having one end secured to the support and a second opposite end threadably received in the internally threaded recess, whereby the bearing bracket may be adjustably positioned horizontally relative to the support.

17. An apparatus for activating a flush valve handle comprising:

a lower housing having a bottom, sidewalls and a cover;

a pair of lower parallel channel guides positioned on the bottom in the lower housing, said guides further positioned having the channels thereof oriented facing one another;

a pair of slidable foot lever pivots, each pivot having a respective pivot portion, each pivot portion being slidably received in a respective channel formed in the lower channel guides;

a foot lever positioned in the lower housing between the pivots extending outwardly therefrom, the foot lever having a first end positioned in the lower housing and a second opposite end positioned outside the lower housing for receiving downward force thereon;

the foot lever being secured to each slidable pivot, whereby the foot lever pivots about the pivot portion, such that downward movement on the second opposite end of the foot lever moves the first end upward; and such that downward movement of the first end moves the second end upward, and further whereby the foot lever is horizontally adjustable in the lower channel guides;

a cup pivotally secured to the first end of the foot lever for concomitant pivotal and slidable movement therewith;

an extension rod having a lower end received within the pivotably secured cup in the lower housing for vertical upward and downward movement in response to the concomitant movement of the cup and for horizontal adjustable movement in response to the concomitant movement of the cup;

an upper housing having a bottom, sidewall and a cover;

a coil spring housing positioned in the upper housing;

a resilient coil spring positioned in the coil spring housing;

the extension rod further having an upper end including a fixed bearing plate annularly extending therefrom, the upper end received in the coil spring housing with the coil spring being positioned between the spring housing and the bearing plate for constantly urging the extension rod vertically downward;

a flush arm positioned in the upper housing and extending outwardly therefrom, perpendicular to the extension rod, the flush arm having a first end located in the upper housing and a second opposite end located outside of the housing, the first end being pivotably secured to the upper end of the extension rod, such that upward movement of the upper end of the extension rod moves the first end of the flush arm concomitantly therewith;

a bracket adopted to be secured to the flush valve handle, the bracket having a lower portion positioned below the flush valve handle, said lower portion having a channel formed therein;

the second opposite end of the flush arm having at least one rotatable wheel carried thereon and extending outwardly therefrom, said second opposite end of the flush arm being received within the lower portion of the bracket and having the rotatable wheel rotatably guided in the channel, such that upward movement of the first end of the flush arm pivotably moves the second opposite end of the flush arm downwardly concomitantly moving the bracket having the flush valve handle secured thereto, whereby the flush valve handle is activated;

each pivot portion having an aperture formed therein below the foot lever, said apertures being aligned with one another;

a pivot shaft having a pair of opposite ends, said pivot shaft being received through each respective aligned aperture extending therefrom;

a rotatable pivot wheel positioned on each respective end of the pivot shaft outwardly of the pivots, each pivot wheel being slidably received in a respective channel of the parallel channel guides, whereby the foot lever and the lower end of the extension rod may be horizontally adjusted;

at least one bearing bracket;

means for adjustably securing the bearing bracket to a vertical support, whereby the bearing bracket horizontally extends therefrom;

said bearing bracket having a ring formed therein opposite the support;

a bearing sleeve annularly positioned in the ring;

wherein the extension rod is received through the ring and the bearing sleeve positioned therein, being supported and slidably guided therein at an adjustable distance from the support;

wherein the means for adjustably securing the bearing bracket to the support includes the bearing bracket having an internally threaded recess formed therein, and a threaded rod having one end secured to the support and a second opposite end threadably received in the internally threaded recess, whereby the bearing bracket may be adjustably positioned horizontally relative to the support;

the upper housing further having a pair of parallel channel guides positioned on the bottom thereof having the channels thereof oriented towards each other defining a channel therebetween;

the coil spring housing having a lower end wherein an annular slot is formed thereby defining an annular collar therebelow, the annular collar being slidably received and guided in the parallel channel guides positioned in the upper housing, whereby horizontal movement of the upper end of the extension rod is permitted;

the upper housing further having a pair of parallel flush arm channels formed therein;

a cover plate slidably positioned in the parallel flush arm channels, said cover plate having an aperture formed therein;

the flush arm being received through the aperture formed in the cover plate;

wherein the bracket includes an upper and a lower split sleeve, each of said sleeves being secured to each other about the flush valve handle, a plate integrally formed with the lower split sleeve and extending downwardly therefrom, and means for adjustably securing the channel to the plate opposite the lower split sleeve and including one of the plate or channel having at least a pair of apertures formed therein;

the other plate or channel having at least a pair of elongated slots formed therein;

a pair of bolts, a respective bolt received through one of each a respective aperture and a respective slot; and a nut received on each bolt for securing the channel to the plate, whereby the channel may be adjusted vertically relative to the flush valve handle.

18. In an apparatus for actuating the flush valve handle of a urinal by means of the user's foot, wherein the urinal is mounted on a wall and extends forwardly therefrom, the improvement which comprises an upper housing means disposed on the wall substantially laterally of the flush valve handle, first mounting means for mounting the upper housing means on the wall, the first mounting means including means for adjusting the upper housing means in a horizontal direction substantially perpendicular to the wall, pivoted arm means carried by the upper housing means and extending therefrom towards the urinal and disposed substantially below the flush valve handle, bracket means between the arm means and the flush valve handle, means for adjusting the bracket means in a vertical direction substantially parallel to the wall, a lower housing means disposed below the upper housing means, second mounting means for mounting the lower housing means on the wall, the second mounting means including means for adjusting the lower housing means in a horizontal direction substantially perpendicular to the wall, a pivoted foot lever carried by the lower housing means and extending therefrom outwardly of the wall, and means including a vertical rod extending between the upper housing means and the lower housing means for connecting the pivoted foot lever to the pivoted arm means; wherein, when the pivoted foot lever is depressed by the user's foot, the rod moves vertically, pivoting the arm means downwardly, and thus moving the bracket means and the flush valve handle downwardly to flush the urinal; whereby the respective means for adjusting the upper housing means and the lower housing means relative to the wall and in a substantially horizontal direction, and the means for adjusting the bracket means in a substantially vertical direction, assures compatibility with existing installations for retrofit purposes.

19. The improvement of claim 18, further including means for adjusting the vertical rod in a substantially horizontal direction towards and away from the wall.

20. In combination with a urinal mounted on a wall and having a flush valve handle, an apparatus for actuating the flush valve handle by means of the user's foot, comprising first pivoted linkage means carried by the flush valve handle laterally of the urinal, a first adjustable mounting means for adjustably mounting the first pivoted linkage means to the wall laterally of the flush valve handle, so that the first pivoted linkage means is adjustable relative to the flush valve handle in a substantially horizontal direction, a first adjustable bracket means between the first pivoted linkage means and the flush valve handle for adjustably securing the first pivoted linkage means to the flush valve handle, so that the first pivoted linkage means is adjustable relative to the flush valve handle in a substantially vertical direction, second pivoted linkage means including a foot pedal extending substantially perpendicularly of the wall outwardly thereof and adapted to be depressed by the user's foot, a second adjustable mounting means for adjustably mounting the second pivoted linkage means relative to the wall for movement towards and away from the wall, so the foot pedal is adjustable relative to the wall in a substantially horizontal direction, third pivoted linkage means pivotably connected between the first and second pivoted linkage means, and means for adjusting the third pivoted linkage means in a substantially horizontal direction towards and away from the wall, whereby the respective first adjustable mounting means and the first adjustable bracket means for horizontally and vertically adjusting the first pivoted linkage means relative to the flush valve handle, the second adjustable mounting means for horizontally adjusting the second pivoted linkage means relative to the wall, and the means for horizontally adjusting the third pivoted linkage means relative to the wall assures compatability of the apparatus with existing installations for retrofit purposes.

* * * * *